United States Patent [19]

Stone

[11] 4,106,571

[45] Aug. 15, 1978

[54] PNEUMATIC IMPACT DRILLING TOOL

[75] Inventor: Charles W. Stone, Garden City, Mich.

[73] Assignee: Reed Tool Co., Houston, Tex.

[21] Appl. No.: 747,769

[22] Filed: Dec. 6, 1976

[51] Int. Cl.[2] ..... B25D 17/14

[52] U.S. Cl. ..... 173/64; 173/71; 173/73; 175/100

[58] Field of Search ..... 138/45; 173/57, 71, 173/73, 78, 80; 175/100

[56] References Cited

U.S. PATENT DOCUMENTS

| | | | |
|---|---|---|---|
| 2,859,733 | 11/1958 | Bassinger | 173/71 |
| 2,917,025 | 12/1959 | Dulaney | 173/78 X |
| 2,998,085 | 8/1961 | Dulaney | 175/100 |
| 3,045,768 | 7/1962 | Huffman | 173/78 X |
| 3,077,903 | 2/1963 | Honsinger | 138/45 |
| 3,667,555 | 6/1972 | Elenburg | 175/100 X |
| 3,944,003 | 3/1976 | Curington | 173/73 |
| 3,964,551 | 6/1976 | Bassinger | 173/73 |
| 4,054,180 | 10/1977 | Bassinger | 173/73 X |

*Primary Examiner*—Lawrence J. Staab
*Attorney, Agent, or Firm*—Neal J. Mosely

[57] ABSTRACT

A pneumatically operated impact drilling tool for earth drilling, includes a reciprocating hammer, an anvil positioned under the hammer and a feeder tube extending through the hammer. The drilling tool is connected to a string of drilling pipe and high pressure compressed air or other pneumatic fluid is introduced to operate the tool. The feeder tube directs the flow of fluid through ports in the hammer to alternate pressure on opposite sides of the hammer to move the same upward and downward relative to the anvil. An elastomeric check valve is positioned inside the upper end of the feeder tube. The air inlet end of the tube is also provided with air jet passages extending upward and outwardly and having check valves operated in the outflow direction. A flow controlling washer may also be provided at the inlet to the check valve in the feeder tube.

5 Claims, 3 Drawing Figures

PNEUMATIC IMPACT DRILLING TOOL

BACKGROUND OF THE INVENTION

1. Field of the Invention

This invention relates to impact drilling tools and more particularly to pneumatically actuated impact drilling tools for earth drilling. The tool utilizes a reciprocally movable hammer which strikes an anvil to create an impact force on the drill bit.

2. Description of the Prior Art

Prior to the development of the present invention there have been numerous types of pneumatically operated impact drilling tools. Bassinger U.S. Pat. No. 3,616,868 discloses an earlier form of pneumatic fluid actuated impact tool. Another form of pneumatically operated impact tool is shown in Bassinger U.S. Pat. No. 3,826,316. There are many types of pneumatically operated devices which have been suggested to provide a repeated impact on a drill bit. Normally, the drill bit is attached to or a part of an anvil that is hit by a reciprocating hammer.

In a pneumatically operated reciprocating hammer there are several valve functions which must be performed. A check valve is required to prevent back flow of air within the drilling tool which might draw cuttings within the moving parts of the tool. A valve function should also be provided to cause compressed air to exert force on the lower end of the hammer to raise the same relative to the anvil. Other valve functions are required to exhaust the pressurized air which raises the hammer and to supply compressed air to the upper end of the hammer to drive the same against the anvil. On each reversal of movement of the hammer the pressurized air on the opposite end must be exhausted before the hammer is moved.

In pneumatically operated rotary drilling tools, the drill rate of a standard drill bit using standard air pressure becomes the key to the success of the percussion tool. However, increased drilling rate cannot be accomplished at the expense of destroying the drill bit. It has been found in the past that a standard hold down force can be applied to rotary drill bits with an impact force being superimposed thereon to greatly increase the rate of drilling. It has also been found that if the impact force is increased and the hold down force decreased the drill rate can be increased without damage to the drilling equipment. Since the pressure of the pneumatic fluid is normally fixed, the downward impact of the hammer is dependent upon the upper surface area subjected to the pneumatic pressure, the stroke length of the hammer and the time required for pressurization and exhaust.

A typical pneumatically operated impact drilling tool sold commercially is illustrated in U.S. Pat. No. 3,503,459. The drilling tool shown in this patent has certain limitations including weak structural walls of the casing, expensive to manufacture, smaller surface area in the hammer and slow pressurization and exhaust. Any undercut or passage through the casing of an impact drilling tool seriously weakens the lateral strength of the tool, especially for small diameter tools. The pneumatic tool of the aforementioned patent is particularly weak in the outer casing which makes it subject to damage during operation.

Various types of percussion drilling devices have been designed and patented where the entire upper diameter of the hammer is acted upon by the pressurized fluid to drive the hammer downward against the anvil. However, to perform the necessary valving functions each of these devices requires undercuts in the casing with cross bores, slots, undercuts and/or vertical feeds being necessary within the hammer element itself. To insure against structural damage of the hammer element, each of these bores, cross slots, undercuts, etc., must end in a rounded surface. All of these problems result in decreased strength of the hammer, increased expense of manufacture and decreased lateral strength of the drilling tool.

In Bassinger U.S. Pat. No. 3,964,551, there is shown a pneumatically operated percussion type rotary drilling tool having a hammer element which reciprocates along the axis of the drilling tool to strike an anvil which is integral with a bit. The hammer is repeatedly raised and driven downward by pneumatic fluid and valving functions are controlled from the center of the hammer element. No undercuts or feeds extend through the casing. The pressurization and exhaust times are minimum. That pneumatic impact tool, however, is somewhat more complex than is desirable, particularly in the design of the feeder tube and the necessity for special cooperative tubing and valving for exhausting compressed air from the tool.

SUMMARY OF THE INVENTION

This invention relates to a new and improved pneumatically actuated impact tool for rotary drilling. The hammer element reciprocates along the axis of the drilling tool to strike an anvil repeatedly which has a bit integral therewith. The hammer is repeatedly raised and driven downward by the pneumatic fluid that is normally supplied to the drill bit through the drilling pipe. All valving functions are controlled from the center of the hammer element thereby allowing a maximum surface area against which the pressurized pneumatic fluid acts in driving the hammer against the anvil. The structure is further simplified in that a single feeder tube extends through the hammer so that the pneumatic fluid is continuously blown through the tool while alternately being applied to the hammer for reciprocation thereof. The tool has a system of check valves controlling flow of pneumatic fluid into the hammer piston and controlling flow of pneumatic fluid outward through a system of flushing nozzles. Optionally, the tool may be provided with a flow regulating washer for equalizing flow of pneumatic fluid at different pressures.

DESCRIPTION OF THE PREFERRED EMBODIMENT

The novel features of this invention are applicable to any center feed pneumatic impact tool or drill and are particularly adaptable to a tool of the type shown in Bassinger U.S. Pat. No. 3,964,551 or in my co-pending application Ser. No. 748,011, filed Dec. 6, 1976. For convenience, the invention is described below as applied to the tool shown in my co-pending application.

Figure 1A:
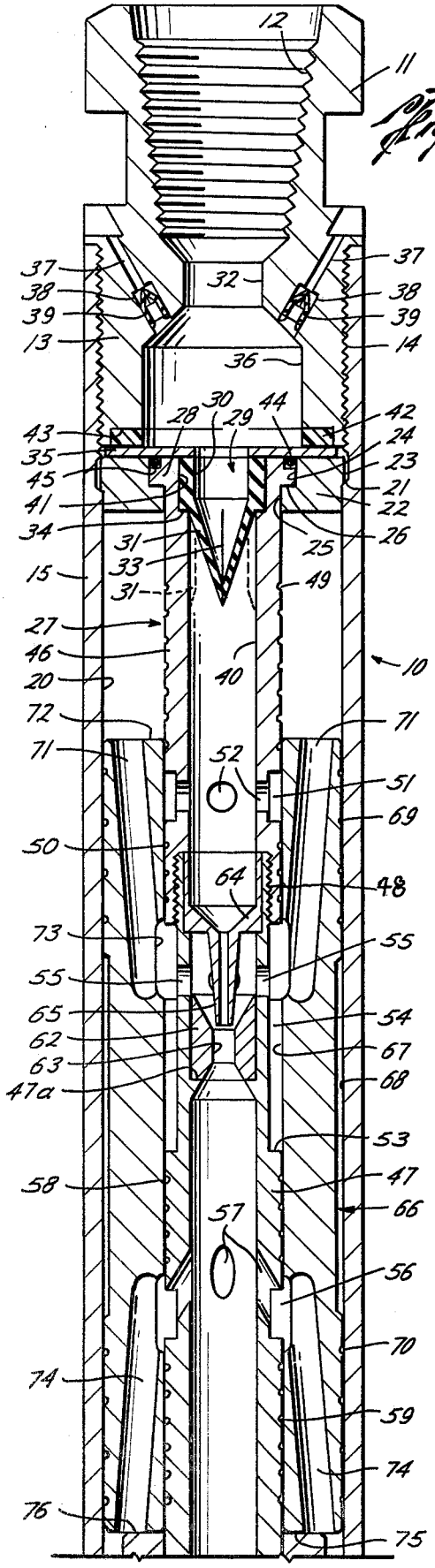
FIGS. 1A and 1B are sectional views taken along the longitudinal axis of a pneumatic tool constructed in accordance with this invention.
Figure 1B:
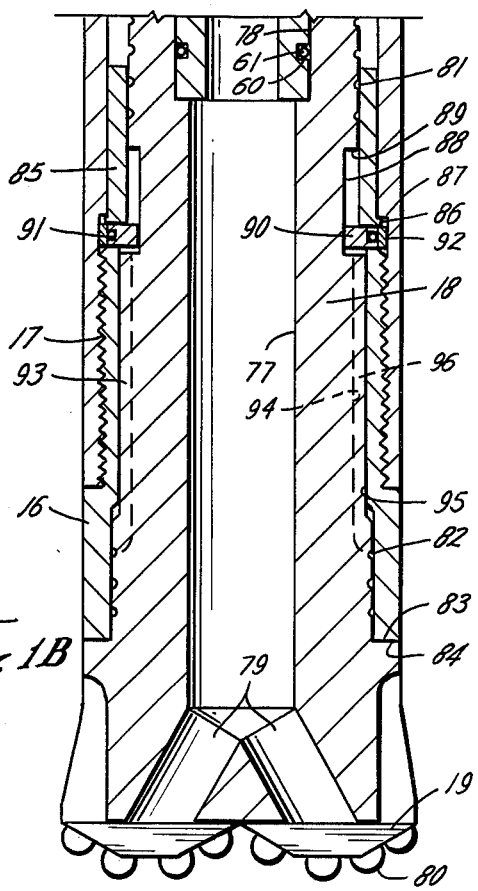

Referring to the drawings by numerals of reference and more particularly to FIGS. 1A and 1B in combination there is shown a longitudinal cross sectional view of the present invention wherein the reference numeral 10 represents the pneumatic impact drilling tool. FIGS. 1A and 1B represent the tool cut into two pieces with the upper portion of FIG. 1B being a continuation of the lower end of FIG. 1A. This pneumatic drilling tool is designed for connection in a string of drilling pipe immediately above a drill bit. The pneumatic tool 10 has an upper sub 11 which is internally threaded as at 12 for connection to a string of drill pipe (not shown). The lower end portion 13 of sub 11 is threadedly connected as indicated at 14 to the open upper end of casing 15 of the tool 10. The bottom end of casing 15 is connected to a driver sub 16 by threaded connection 17. Anvil member 18 is slidably positioned in sub 16 and is formed integrally with drill bit 19.

Casing 15 has a smooth inner bore 20 for guiding the hammer piston as will be subsequently described. The upper end of the casing bore 20 is enlarged and threaded as shown at 14 and has a very slight shoulder 21 at the base of the threads. A cylindrical retaining plug 22 is positioned in the upper end of casing bore 20 and has a very slight shoulder 23 which engages shoulder 21 and limits movement of the retaining plug 22 in the casing bore. The plug 22 is very closely fitted in place and is held firmly in position to resist movement. Plug 22 has an enlarged bore 24 and a smaller bore 25 connected by inwardly extending flange 26.

A feeder tube 27 is positioned in casing 15 and has a flange 28 at its upper end fitted within the bore 24 of plug 22 and resting on inwardly extending flange 26. The details and function of feeder tube 27 will be described more fully hereinafter.

Casing 20 is provided with a check valve 29 positioned between retainer plug 22 and upper sub 11. The check valve 29 allows compressed air or other pneumatic fluid to flow from the string of drilling pipe through the tool to the drill bit but prevents back flow which might carry cuttings into the tool and cause substantial damage. Check valve 29 is of natural or synthetic rubber, or equivalent elastomeric material, and includes a thick cylindrical base 30 having a tapered end 31 which is cut or slit along line 33. The tapered end 31 has the appearance of a duck's bill and this type of check valve is known as a duck bill check valve.

In the relaxed, unstressed condition shown in full line, the check valve 29 is closed. When compressed air, or other pneumatic fluid, enters through sub 11, the tapered end 31 of the check valve opens as indicated in dotted line. When the air or gas flow is cut off the check valve closes and prevents back flow through the tool. The thick, cylindrical base 30 of the check valve fits in an enlarged bore 41 against shoulder 34 in feeder tube 27 so that the entire check valve 29 is positioned within the feeder tube.

Check valve 29 is secured in place by a retainer plate 35 which is tightly held against the end face of retaining member 22. Plate 35 also abuts the end of feeder tube 27 to hold the same in position. A washer or makeup ring 42 is positioned in a recess 43 in the end of upper sub 11 and abuts a retainer plate 35. When the upper sub 11 is assembled into the threaded connection 14, as shown in FIG. 1A, the washer 42 (which is of a suitable elastomeric material) is tightened against plate 35 to hold feeder tube 27 and check valve 29 tightly in position. An O-ring or other suitable seal 44 of suitable elastomeric material is positioned in a peripheral groove 45 on flange 28 to seal against leakage of compressed air at the inlet end to feeder tube 27. This sealing arrangement prevents the possible buildup of air pressure in the space adjacent the upper end of the feeder tube without the compressed air having gone through the valving which is designed to direct it for movement of the hammer piston.

Upper sub 11 has an enlarged bore 36 open through a slightly restricted opening 32 into threaded opening 12. A plurality of passages 37 open diagonally outward and upward from the bore 36. Passages 36 each have an enlarged portion 38 in which there are positioned small duck bill check valves 39 of natural or synthetic rubber or equivalent elastomeric material. When the bore 36 is pressurized with compressed pneumatic fluid, the check valves 39 open and jets of pneumatic fluid pass through passages 37 to assist in clearing cuttings and debris from around the tool. When the source of compressed pneumatic fluid is cut off, the check valves 39 close and protect the tool against contamination by back flow of gas containing debris.

Feeder tube 27 comprises upper portion 46 and lower portion 47 which are secured together by a threaded connection 48. Feeder tube 27 may be of one-piece construction, if desired. The upper feeder tube portion 46 is provided with upper and lower peripheral grooves 49 and 50 for retaining oil or other lubricant for lubricating the movement of the hammer piston on the feeder tube. Upper feeder tube portion 46 is provided with a peripheral groove 51 and a plurality of apertures 52 opening into said groove for controlling air flow.

The lower portion 47 of feeder tube 27 has a peripheral shoulder 53 adjacent an upper end portion of reduced diameter which cooperates with the lower end of upper tube portion 46 to define a longitudinally elongated peripheral groove 54. A plurality of apertures 55 open from inside the tube portion 47 into peripheral groove 54.

Still further down the length of feeder tube 27 on the lower tube portion 47 there is provided a peripheral groove 56. A plurality of angularly directed passages 57 open through the wall of the lower tube portion 47 into peripheral groove 56 for directing flow of compressed air as will be subsequently described. The lower tube portion 47 is provided with upper and lower peripheral grooves 58 and 59 which function to retain oil or other lubricant for lubricating the hammer piston which is slidably positioned on the feeder tube. There is provided another peripheral groove 60 at the lower end of the lower feeder tube portion 47 in which there is positioned an elastomeric O-ring 61 for sealing the sliding joint between the feeder tube and the anvil bit member, as will be described hereinafter.

In the middle portion of the feeder tube 27, adjacent the threaded connection between the upper and lower portions 46 and 47, there is provided an air nozzle and venturi arrangement for providing a substantial evacuation of certain areas within the tool during certain stages in the operation thereof. Tubular member 62 has beveled inlet and outlet portions and a restricted central opening 63 providing a venturi for injection of compressed air to provide an evacuation of other portions of the tool as will be hereinafter described. The tubular member 62 is held in place by a press fit assembly against shoulder **47*a*. A hollow tubular nozzle member 64 having an elongated nozzle shaped extension 65 is held in position by a press fit at the end of the lower tube portion 47 adjacent the threaded connection 48. The nozzle shaped extension 65 is positioned to discharge a jet of compressed air through the restricted opening 63 forming the throat of a venturi. The venturi throat and nozzle are positioned adjacent to apertures 55** in the feeder tube and are operable to draw a substantial vacuum through said apertures to evacuate other portions of the tool according to the location of the hammer piston and its valve openings on the feeder tube.

Hammer piston 66 is positioned on feeder tube 27 for longitudinal sliding movement thereon. Hammer piston 66 has a smooth inner bore 67 and a central portion 68 of slightly reduced diameter providing a small clearance relative to the bore of the casing 15. The upper and lower end portions of hammer piston 66 have a relatively close sliding fit in the smooth bore 20 of casing 15. These portions which have a sliding fit in the casing are provided with upper and lower peripheral grooves 69 and 70, respectively, which retain oil or other lubricant for lubricating the sliding movement of the outer surface of hammer piston 66 in the bore 20 of casing 15. As previously described, the inner surface 67 of hammer piston 66 is smooth and has sliding contact along feeder tube 27, aided by lubricant retained by lubricant retaining grooves 48 and 40 and grooves 58 and 59, respectively.

Hammer piston 66 is provided with a plurality of longitudinally extending, somewhat slanted passages 71 which extend from the upper end face 72 of the hammer piston 66 to undercut portion 73 which provides a valving action according to the position of the hammer piston on the feeder tube. There are also provided a plurality of longitudinally extending, somewhat slanted passages 74 which extend from the lower end face 75 of hammer piston 66 to the undercut portion 76 which opens into the sliding bore of the hammer piston and provides a valving function depending upon the position of the hammer piston on the feeder tube.

At the lower end of casing 15, anvil bit member 18 is positioned for longitudinal sliding movement. The upper end surface 76 of anvil-bit member 18 provides an anvil surface which is pounded upon by the lower end surface of hammer piston 66. Anvil-bit member 18 has a longitudinally extending passage 77 which is slightly enlarged at its upper end as indicated at 78 to receive the lower end of lower feeder tube portion 47 and which has a sliding fit with the sealing gasket or O-ring 61. The lower end of longitudinal passage 77 in anvil member 18 intersects a plurality of passages 79 which extend outward into the lower face of bit member 19 which is preferably provided with a plurality of tungsten carbide or other hardened cutting inserts 80. Anvil-bit member 18 has a plurality of upper peripheral grooves 81 and lower peripheral grooves 82 which retain oil or other lubricant for lubricating the longitudinal movement of the anvil-bit under repeated hammering by hammer piston 66. The bit end 19 of anvil-bit member 18 has a peripheral shoulder 83 which abuts the lower end 84 of casing 15 when the tool is resting with the bit 19 on the ground or on the bottom of a hole being drilled.

A tubular anvil-guide sleeve 85 is positioned closely in the lower end of the bore 20 of casing 15. At the lower end of sleeve 85 there is a very small shoulder 86 which abuts a peripheral shoulder 87 at the top of the threaded connection 17 between driver sub 16 and the lower end of casing 15. The upper end portion of anvil-bit member 18 is slidably positioned in the inner bore of retainer sleeve 85. Anvil-bit member 18 has a wide peripheral groove 88 around its upper end having an upper shoulder 89 which engages a stop ring to prevent the anvil-bit from dropping out of the tool when supported off bottom. The bit retainer ring 90 is a split ring having a peripheral groove in which there is positioned an O-ring 91 which secures the pieces of the split ring together. In assembling the apparatus, the anvil-bit member is first inserted through the driver sub 16 and the split ring 90 assembled on the wide groove 88 and retained in position by O-ring 91. The sub-assembly can be inserted into the lower end of casing 15 with the upper end of the anvil bit member extending into the guide sleeve 85. Driver sub 16 is then screwed into position and abuts the lower edge of split ring 90 to hold the same against the lower end of guide sleeve 85 and to hold the shoulder 86 against the shoulder 87 on casing 15. Split ring 90 is held in this position surrounded by an elastic snap ring 92 which fits around the periphery of the assembled split ring 90 and abuts the end of sleeve 85.

Anvil-bit member 18 is provided with a plurality of splines 93 and splineways 94 which cooperate with mating splineways 95 and splines 96, respectively, in driver sub 16. This system of splines and splineways allows longitudinal sliding movement of anvil-bit member 18 while providing a means to cause the bit to rotate with the tool as it is rotated by the string of drilling pipe to which it is connected.

OPERATION

In FIGS. 1A and 1B, the drilling tool is shown in the position for the parts when it has been assembled on a drilling string and placed against the ground or in a hole to commence drilling. The position of the parts as shown is just prior to pressurizing the tool with compressed air or other pneumatic fluid. When the air pressure is turned on using a suitable compressed air source, preferably about 100–200 psi, the air under pressure will first cause valve 29 to open as previously described. Air under pressure then passes directly into the bore 40 of feeder tube 27. At the same time, check valves 39 open to cause jets of compressed air to discharge through passages 37 to assist in removal of debris from around the tool.

The compressed air passes down the bore of feeder tube 27 through nozzle 65 and constricted passage or venturi 63. The compressed air continues to flow continuously on through the bore 77 and outlet passages 79 from anvil-bit member 18. The compressed air which moves at a higher velocity as a result of passing through nozzle 65 moves through the venturi passage 63 at a relatively high speed and produces a venturi effect resulting in evacuation of air from the space around nozzle 65 and the spaces communicating with that space by the adjacent passages. It has been found experimentally a nozzle and venturi structure of the type shown will evacuate a volume equal to the space above the hammer piston 66 and associated passages to about 16–18 in Hg vacuum. This vacuum is created around the venturi 63 and nozzle 65 and draws air from the passages 71 and from the space above the top of the hammer piston 72.

In the piston shown, the compressed air from the lower part of the bore 40 below the venturi opening 63 may communicate through passages 57, annular groove 56, and passages 74 to the space below the bottom end 75 of hammer piston 66. In this position, using the air pressure suggested, the space below the bottom end 75 of hammer piston 66 is pressurized to the operating air pressure less the pressure drop through the venturi.

This would be a pressure slightly less than the inlet pressure of 100–200 psi. At the same time that the lower end 75 of hammer piston 76 is subjected to high pressure, the space at the upper end 72 of hammer piston 66 is evacuated to a vacuum of the order of 16–18 inches. This pressure differential causes hammer piston 66 to rise rapidly along feeder tube 27.

As hammer piston 66 is moved upward under the pressure differential described above, the relationship of the various valve ports and passages is changed. The upward movement of hammer piston 66 will first cause the lower passages 74 to be closed as the opening 76 moves away from annular groove 56 and over the adjacent surface of the feeder tube. At the same time, the movement of hammer piston 66 upward causes the opening 73 from passages 71 to be closed as it moves away from annular groove 54 and over the upper surface of the upper portion 46 of feeder tube 27.

For a short part of the movement of hammer piston 66, both the upper and lower ports are closed and no air is being supplied to or evacuated from the space on either end of the piston. At the time the ports are all closed, the pressure below the piston is still a relatively high pressure and a vacuum still exists above the upper end of the piston. This pressure differential causes the piston to move upward until it reaches a fully raised position.

When the piston reaches the fully raised position the high pressure air communicates through passages 52 and annular groove 51 to the inlet undercuts 73 opening into passages 71. In this position, high pressure air passes into the space between the upper end 72 of hammer piston 76 and the lower surface of retaining member 22. The space above the hammer is then subjected to a high pressure which approaches the inlet pressure of the compressed air.

In this same position of hammer piston 66, the high speed ejection of air through nozzle 65 and venturi 63 causes the space around the nozzle and venturi to be evacuated and to withdraw air through passages 55, annular groove or recess 54, and passages 74 communicating with the space between the lower end 75 of hammer piston 66 and the anvil face 76 and upper surface of retaining sleeve 85. In this position, the feeder tube is still maintained inside the end of anvil-bit member 18 so that the space being evacuated by the nozzle 65 and venturi 63 is a tightly enclosed space. This space is evacuated to a vacuum of about 16–18 inches Hg using compressed air of about 100–200 psi in the operation of the tool.

In the raised position, the upper end 72 of hammer piston 66 is subjected to compressed air and the lower end is evacuated to provide a substantial pressure differential across the hammer piston. Under this differential of pressure, the hammer piston is driven downward to pound against the upper surface 76 of anvil-bit member 18. As the hammer piston 66 moves downward the various ports first close off the various passages, as was described for the upward stroke of the hammer, leaving the space above the hammer at a high pressure and the space below the hammer at a low pressure. As the hammer piston 66 moves downward to impact against the upper surface 76 of anvil-bit member 18 it reaches the position shown in FIGS. 1A and 1B. In that position, the relationship of the various ports is as described above and compressed air is applied again to the lower face 75 of the hammer piston and the space above the upper end face 72 of the hammer piston is again evacuated. This arrangement of ports and passages for application of compressed air and a vacuum to alternate ends of hammer piston 66 causes the piston to reciprocate upwardly and downwardly along feeder tube 27 to pound repeatedly on the upper face 76 of anvil-bit member 18. While the hammer piston 66 is repeatedly beating upon the upper face 76 of anvil-bit member 18 the drill string (not shown) is rotating the tool and bit 19 is caused to rotate with the tool by means of the relationship between the splines and splineways in anvil-bit member 18 and driver sub 16, as described above.

Figure 2:
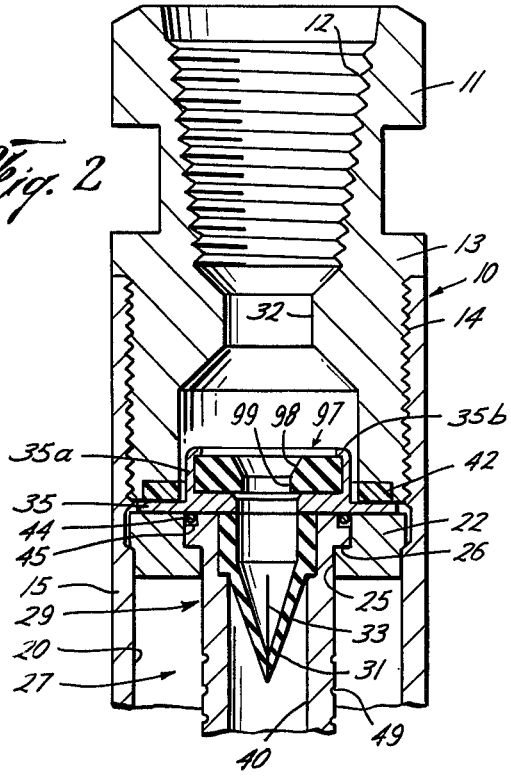
FIG. 2 is a sectional view of an embodiment of the invention including a flow-regulating washer.

In the embodiment shown in FIG. 2 the tool is additionally provided with a flow-controlling washer 97 which is secured in a tubular extension **35*a* projecting from plate 35 and crimped as indicated at 35*b*. Washer 97 is preferably of elastomeric material such as natural or synthetic rubber. Washer 97 has a tapered opening 98 leading to a more restricted opening 99. At low pressure differentials across washer 97, the washer is maintained in the position shown. If surges or rapid changes in pressure occur, the washer 97 will be deformed into the opening in the base of check valve 29 thus restricting air flow. A sudden increase in air pressure which would increase the volume of air flowing through the tool would cause washer 97 to restrict the flow and compensate for the higher pressure differential. This deflection of washer 97** will act to regulate the compressed air flow and maintain a relatively constant volume even with substantial pressure changes. Washers of this type are commonly used to maintain constant flow under varying pressure in flow-controlling valves.

The pneumatic impact drilling tool, described above, has a number of advantages over the prior art. This tool is substantially simpler in construction, utilizes fewer parts, and is easier to construct. The feeder tube acts as a guide and valving mechanism for the hammer piston and is maintained in continuous communication with the anvil-bit member. This results in the continuous circulation of compressed air through the tool and out through the ned of the bit member to remove cuttings from the area being cut by the hammer. The tool has substantially increased strength in view of the elimination of uppercuts and passages in the casing which are found in prior art tools of this type. The use of a separate valve and exhauster tube is eliminated in this construction as a result of the continuous communication of the feeder tube with the anvil-bit member. The air nozzle and venturi arrangement used in this construction results in an increased pressure applied to the down stroke and provides a negative pressure or vacuum to accelerate the exhaust of air from the casing and to assist by providing an increased pressure differential across the hammer piston.

The use of the duck bill check valve makes it possible to place the check valve inside the feeder tube and eliminate the exterior check valve required in prior tools. This check valve offers less flow resistence and permits greater air circulation through the tool. The air jets with interior check valves provide separate paths for air used to remove cuttings and air used to operate the hammer. There is a continuity of debris-removing air at the bit end and at the top of the hammer. The flow-controlling washer assist in maintaining a constant flow rate through the tool.

The improved construction of this invention utilizes standard components with a minimum amount of change. Most of the components of the pneumatic impact drilling tool of U.S. Pat. No. 3,964,551 can be used in this invention with only slight changes made in the feeder tube. The various improved features can be used in the tool of U.S. Pat. No. 3,964,551 or in the modification illustrated and described above.

While this invention has been fully and completely described with special emphasis upon a single preferred embodiment, it should be understood that the inventive concept is limited only by the appended claims.

I claim:

1. An impact drilling tool for connection in a string of drilling pipe comprising an upper sub for connection to said drilling pipe, a casing with an upper end connected to said upper sub, an anvil member slidably positioned in the lower end of said casing and having a bit member on its lower end extending outside said casing, a hammer piston in said casing above said anvil member for reciprocal movement longitudinally of said casing to strike said anvil member repeatedly.

a feeder tube for feeding compressed pneumatic fluid from said drilling pipe extending longitudinally of said casing through said hammer, a plurality of passages and valve openings cooperable therewith in said feeder tube and said hammer piston to apply compressed pneumatic fluid to one end of said hammer piston when in one position and to the other end when said hammer piston is in another position, for effecting reciprocal movement thereof, said casing and said sub defining an inlet chamber for receiving compressed pneumatic fluid in the inlet to said feeder tube, at least one passageway in said tool opening from said inlet chamber diagonally through said sub to discharge pneumatic fluid upward and outward from said tool, and a check valve positioned inside said passageway and opening to discharge fluid outside said tool and closing to prevent flow backward through said passageway into said tool.

2. A drilling tool according to claim 1 in which said check valve is a hollow tubular elastomeric material having a closed end with an opening operable to be flexed open upon application of internal pneumatic pressure.

3. A drilling tool according to claim 2 in which there are a plurality of said passageways.

4. A drilling tool according to claim 3 including an additional passageway including said feeder tube and a check valve positioned in the inlet end of said feeder tube comprising a hollow tubular elastomeric member having a closed end with an opening operable to be flexed open upon application of internal pneumatic pressure.

5. A drilling tool according to claim 1 including additionally an elastomeric deformable annular washer positioned in the end of said feeder tube adjacent said inlet chamber and ahead of said check valve and operable to be deformed into said feeder tube to restrict the same upon increasing pneumatic pressure applied thereto, thereby regulating the volume of flow to maintain the same substantially constant.

* * * * *